United States Patent [19]

Neidhardt et al.

[11] 4,021,213

[45] May 3, 1977

[54] FOOD STORAGE REFRIGERATION CABINET HAVING OPTIONAL FAST CHILL CYCLE

[75] Inventors: Graham B. Neidhardt, Oreland; George Persak, Jr., Malvern, both of Pa.

[73] Assignee: McGraw-Edison Company, Elgin, Ill.

[22] Filed: Aug. 25, 1975

[21] Appl. No.: 607,182

[52] U.S. Cl. ..... 62/180; 62/213; 62/229

[51] Int. Cl.[2] ..... F25D 17/06

[58] Field of Search ..... 62/180, 213, 229, 89

[56] References Cited

UNITED STATES PATENTS

| | | | |
|---|---|---|---|
| 3,530,683 | 9/1970 | Watkins | 62/89 |
| 3,747,361 | 7/1973 | Harbour | 62/180 X |
| 3,877,243 | 4/1975 | Kramer | 62/180 |

*Primary Examiner*—William E. Wayner
*Attorney, Agent, or Firm*—Charles F. Lind

[57] ABSTRACT

This invention teaches a food storage refrigeration cabinet suited for operation either on a conventional refrigeration cycle or on a fast cool down refrigeration cycle. The disclosed cabinet has partition structure that separates a food storage space from a defined plenum, and the evaporator coil of the refrigeration system is located inside the plenum. The partition has inboard and outboard openings to define recirculating air flow paths over the evaporator coil from and to the food storage space. For use of the cabinet on a conventional refrigeration cycle, first fan means in the inboard openings draws air from the storage space and passes the same over the evaporator coil for discharge out the outboard openings back to the storage space, and the refrigeration system is cycled on and off in order to maintain the enclosure air within the proper temperature range. When the cabinet is operated on the cool down cycle, second fan means located in the outboard openings also are operated to discharge the chilled plenum air downstream of the evaporator coil from the outboard openings for highly turbulent circulation in the storage space. The cycle is terminated when the food itself as sensed by food probes reaches the desired storage temperature or after a set timed interval, and during the cycle the refrigeration system preferably runs continuously. The refrigeration system has at least twice and maybe three times the cooling capacity required to maintain the same storage space at the desired storage temperature, and the air in the storage space is extremely turbulent when all the fans are operating.

5 Claims, 4 Drawing Figures

FOOD STORAGE REFRIGERATION CABINET HAVING OPTIONAL FAST CHILL CYCLE

BACKGROUND OF THE INVENTION

In mass institutional feeding places, such as restaurants, hospitals, cafeterias, or the like, it is common to cook or prepare foods in bulk, store the cooked food, and then ultimately sometime later reconstitute or reheat the food and serve same. This is particularly true where the kitchen help works in only certain shifts, but the food might be needed at different and additional times. Thus, many roasts may be prepared simultaneously in an oven, only to have the cooked roasts subsequently stored whole for reheating and proportioning later into individual servings. Likewise, stews or the like may be prepared in large steam table pans, such as 12 inches × 20 inches × 2 inches deep, chilled after cooking and stored, and subsequently reheated, portioned out, and served.

One serious problem with this general approach is that food, particularly meat, is likely to take on bacteria if it is held at moderate temperatures less than 140° F and not yet as cool as 45° F. In fact, the Food and Drug Administration (FDA) under the Department of Health, Education and Welfare considers meat as a hazardous food and has most stringent rules already both for the institutional serving and storing of meat. It is particularly ironic that, as yet, no FDA rules specify any maximum cool down time; to the end that the large cooked masses of food actually linger within this danger temperature range a significant duration in everyday practice using conventional refrigeration equipment.

SUMMARY OF THE INVENTION

The invention teaches a refrigeration cabinet structure that firstly has cooling capacity greatly in excess of that merely needed to maintain the desired low food storage temperatures in the cabinet, and secondly has a cool down cycle which when activated operates additional fans to circulate the air turbulantly within the cabinet, which cool down cycle can be controlled either on a timed basis, or responsive to the actual food temperature, and lastly which cycle has control means to eliminate frost accumulation on the evaporator coil of the refrigeration system.

DETAILED DESCRIPTION OF THE INVENTION

Figure 1:
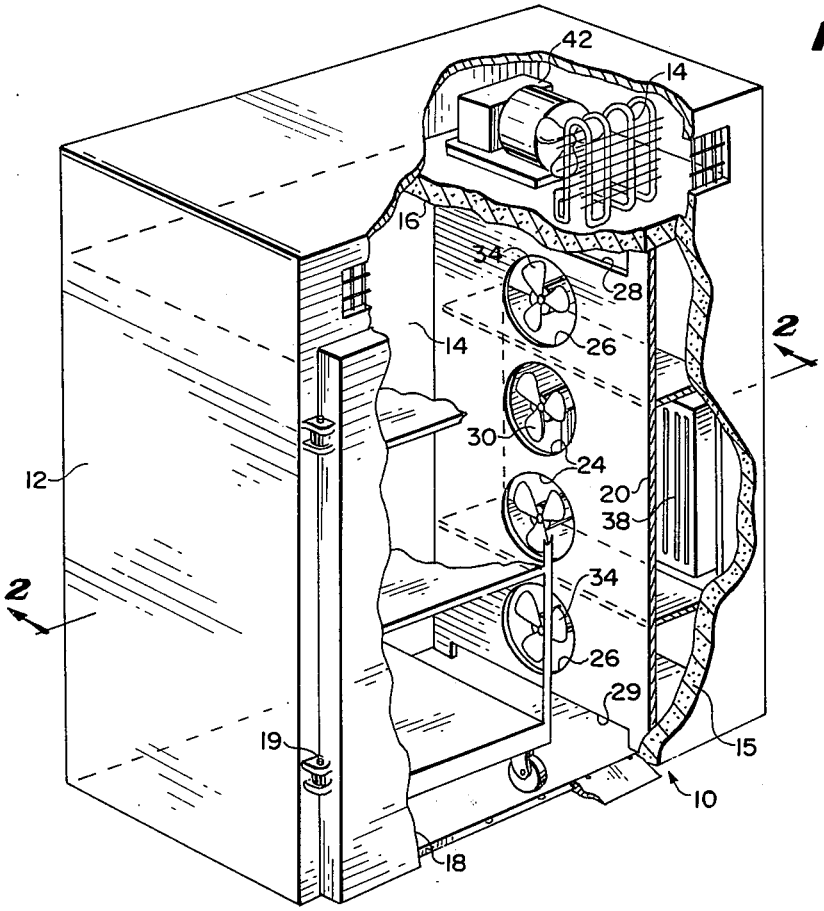
FIG. 1 is a perspective view, partly broken away and in section for clarity of disclosure, of a refrigeration cabinet made in accordance with a preferred embodiment of the subject invention.
Figure 3:
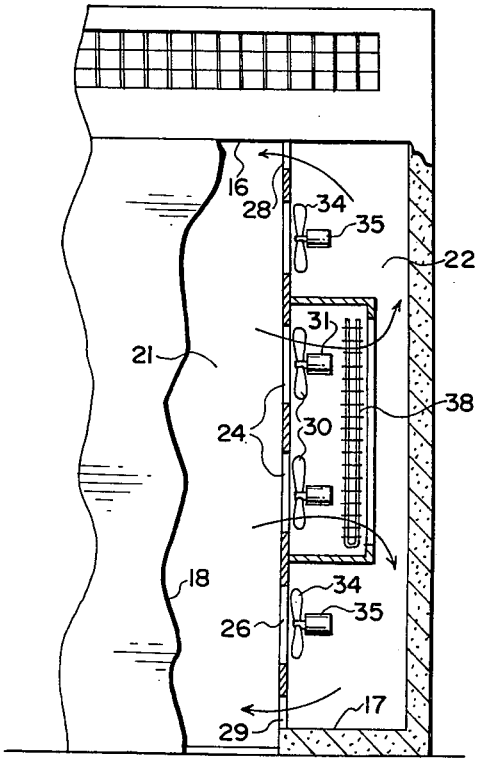
FIG. 3 is a view very similar to that in FIG. 2, schematically showing the operation of the unit on a conventional food storage cycle with only the inboard fans operating.
Figure 2:
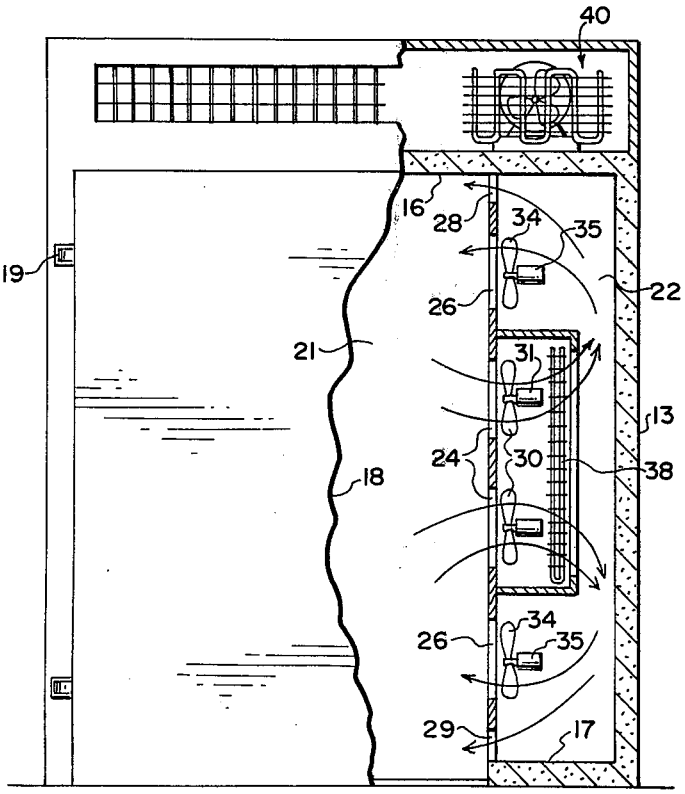
FIG. 2 is a sectional view as seen generally from line 2—2 in FIG. 1, showing particular details of construction of the unit.

In FIGS. 1 – 3, a cabinet 10 is illustrated having opposed insulated side walls 12 and 13, opposed insulated rear wall 14 and front wall 15, opposed insulated top wall 16 and bottom wall 17, and the front wall has an access opening which is closed by an insulated front door 18 hinged at pins 19. A partition 20 connects between the rear wall 14 and front wall 15 and divides the insulated enclosure into a food storage space 21 and a plenum space 22. The cabinet space 21 is sized to accomodate a rolling cart, for example shown in FIG. 1, onto which the products to be stored under refrigeration can be located for easy transfer and conveyence of the goods as is known. When the doors are closed and secured, the cabinet enclosure is generally isolated from the outside atmosphere, as is well known in the refrigeration art.

The partition has therein a pair of inboard openings 24, a pair of outboard openings 26, and a pair of outer openings 28 and 29 located immediately adjacent the top and bottom enclosure walls; and fans 30 driven by motors 31 are mounted within the openings 24 and fans 34 driven by motors 35 are mounted within the openings 26.

The evaporator coil 38 of a typical sealed refrigeration system 40 (FIG. 4) is mounted in the plenum behind inboard openings 24 of the partition panel, and the compressor 42 and condenser coil 44 of the refrigeration system is supported on the top wall 16 in the outside atmosphere. The compressor 42 is connected at its outlet by lines 46 to the condenser coil 44, in turn connected by line 47 to a liquid receiver 48, in turn connected by line 49 to an expansion valve 50, in turn connected by line 51 to the evaporator coil 38, in turn connected by line 53 to the inlet of the compressor 42.

The fans are of the propeller type and the motors are supported in the panel openings by conventional brackets (not shown). Operation of the inboard fans 30 circulates air from the food storage space of the enclosure through the openings 24 and over the evaporator coil for discharge from the plenum both from the outboard openings 26 and from the outlet openings 28 and 29 back into the enclosure. The outboard fans 34 communicate with the plenum air downstream of the evaporator coil and operate to discharge the plenum air directly into the enclosure primarily from the outboard openings. The inboard fans and outboard fans in effect operate in series flow paths on opposite sides of the evaporator coil for recirculating the enclosure air. With all fans operating, the air flow inside the enclosure is highly turbulent which greatly improves the heat transfer cooling characteristics of the food.

It will be understood that the same cabinet structure might be used to merely cool the food through the critical temperature range of 140° to 45° F, at which time the fast cool down cycle may terminate to convert the cabinet to a conventional storage refrigerator unit where the maximum temperature of 45° F is maintained. The cabinet could alternatively be used in a freezer application where the product is intended to be cooled until it actually were frozen, and the degree or density of freezing desired and the expected duration of storage might dictate that the low temperature vary widely from obviously less than 32° F, to typically approximately 0° to 10° F, but possibly even to −20° F or −40° F for extended storage and/or for specialty freezing.

In this regard, the term "refrigeration" is intended broadly to include both what might be known as a "refrigerator" and a "freezer".

In the unit, the cooling capacity of the refrigeration system must greatly exceed that which would normally be required for merely maintaining the food at the safe storage temperature of 45° F, by a ratio of at least two and preferably three to one. In other words, for a refrigerator cabinet where a 45° F maximum temperature range were desired, a conventional refrigerator might require a refrigeration system of ½ horsepower rating; whereas the desired rated system capacity of the disclosed unit would be 1 ½ or even 3 horsepower.

Figure 4:
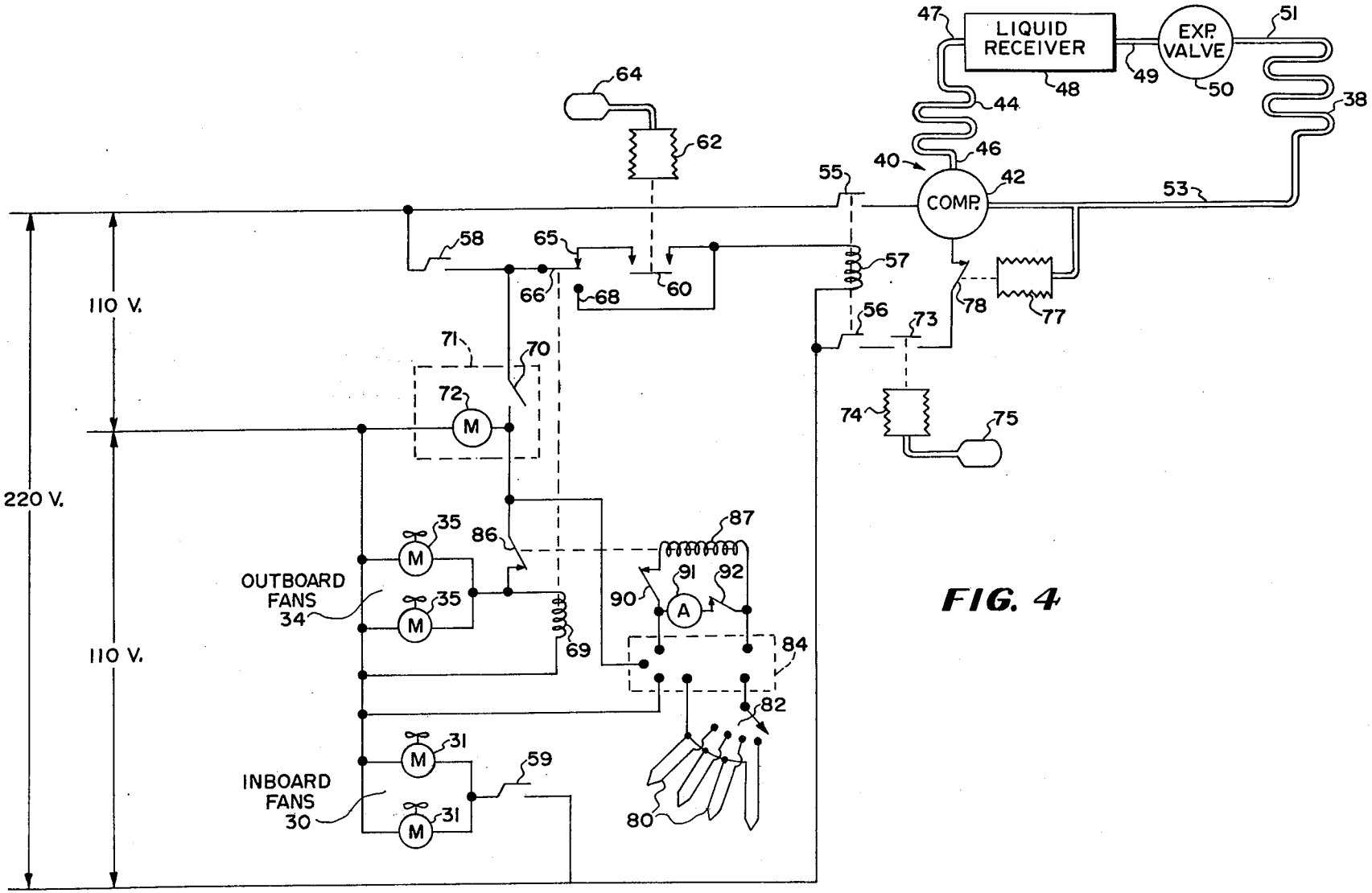
FIG. 4 is a schematic of a control suitable for operating the cabinet shown in FIGS. 1 – 3.

A control suited for operation of the unit on either a conventional refrigeration cycle or a fast cool down cycle is illustrated in FIG. 4. In this control, for example, there is shown a 220V power circuit through the refrigeration compressor 42 and a pair of switch contacts 55 and 56 which are closed upon energizing coil 57. The coil 57 is located in a 220V circuit including main on/off control switch contact 58 and a relay switch 66 that shifts either against contact 65 to connect through refrigeration temperature control contact 60 or against contact 68 when the relay is energized. The relay 66 is shifted by energizing coil 69, as will be noted.

The contact 60 is operated by bellows 62 including a sensing bulb 64, where the bulb 64 would be located in heat sensing relation with the enclosure air, typically in the plenum upstream of the evaporator coil. Consequently, the control responds to variations beyond the set temperature range to open and close the contact 60 and cycle the compressor on and off.

A second contact 59 of the main on/off control switch connects in a 110V circuit through the inboard fan motors 31 to circulate the air throughout the refrigerator enclosure whenever the main on/off control switch contacts 58 and 59 are closed and power is on the unit, even when the refrigerator compressor 42 cycles off.

For use of the cabinet on a normal refrigeration cycle, the relay switch 66 is positioned as shown, and thereby the opening and closing of contact 60 cycles the compressor 42 on and off as the temperature demand requires, while the inboard fans operate continuously.

For use of the subject unit on the fast cool down cycle, switch contact 70 of a timer 71 is manually closed. This energizes timer motor 72 in a 110V circuit to begin a timed sequence for the duration set on the timer. The closed timer contact 70 completes a 110V circuit with the actuating coil 69 of the relay 66 and this shifts the relay leaf against contact 68. This in effect bypasses the temperature control contact 60 in the energizing circuit to the compressor actuating coil 57. The closed timer contact 70 also completes a 110V circuit through the outboard fan motors 35, thereby powering the outboard fans 34.

The compressor 42 operates continuously during this fast cool down cycle until the set time lapses or until the product temperature actually reaches the set temperature, for use of the unit as either a refrigerator or a freezer. However, there are added controls used in the unit which are preferred to stop the compressor, for example, when the cabinet air temperature approaches that which might cause crystallization on or freeze the surface of the food products, which is typically slightly less than 32° F, where the unit is operated as a refrigerator; or until the safe lowest back pressure of the compressor is reached or until the evaporator coil might frost up, where the unit is used as a freezer.

In this regard, the refrigerant system is sealed and has a charge of a high pressure liquid gas refrigerant, such as the E. I. Du Pont Company product FREON 12. Under normal operation, the compressor pressures the refrigerant for flow through the condenser coil 44, the expansion valve 50, and the evaporator coil 38, and the pressure of the system depends on the refrigerant used and its physical properties, as well as the operating temperatures of the condenser and evaporator coils, which depend in part on whether the system were intended for use as a refrigerator or as a freezer. Normally, the temperature of the refrigerant in the evaporator coil is 15° to 20° F cooler than the temperature of the circulating air downstream of the evaporator coil. Consequently, when the unit is to be used as a refrigerator and the enclosure air should not become appreciably cooler than 36° F, the refrigerant temperature in the evaporator coil might approach 20° F. The temperature of the refrigerant in the coil would obviously be much lower when the system is used as a freezer, such as −20° F for a conventional freezer or as cool as −40° F when the unit is operating as an extremely cold temperature freezer.

In order to prevent frost accumulation on the food itself where the unit is operating only as a refrigerator, it is possible to provide another sensing control to interrupt the operation of the compressor. This is illustrated in FIG. 4 and includes a temperature sensing bulb 75 which is located typically in the plenum to sense the chilled air downstream of the evaporator coil. The bulb is connected to bellows 74 which in turn operates contact 73 located in the compressor power circuit. The control is set to deenergize the compressor when the air temperature becomes too cold that freezing might occur, but all of the fans remain on even with the compressor off.

This same control 73, 74, and 75, would be set at a safe temperature lower than the normal storage freezer air temperature of control 60, 62, and 64, by probably 5° to 15° F, when the unit were operated as a freezer, and would thus cycle the compressor off before the operating refrigerant temperature and thus back pressure becomes too low.

There further is provided a control including bellows 77 connected in the system to sense the compressor suction pressure, and the bellows operates a normally closed switch contact 78 in the power circuit of the compressor. The enclosure air flowing over the evaporator coil heats the evaporator coil, to the end that, a normal minimum suction pressure is maintained at the compressor inlet representative of the expected minimum temperature of the refrigerant at this point. As noted, this could be as high as 20° F for a normal refrigerator cycle but could also be as low as −40° F for an extreme cold temperature freezer; but once the parameters of the unit are established, the expected minimum would remain constant.

Upon accumulation of frost on the evaporator coil, the ability of the air to heat the coil is impaired so that the suction pressure at the compressor becomes lower than normal. The bellows 77 senses this reduction of suction pressure and is set to open the switch at some nominal temperature differential, such as 10° to 20° F, below the normal to interrupt the operation of the compressor. By maintaining the operating fans on, either the inboard fan only or both the inboard and outboard fans, during the cycled interruption of the compressor, frost accumulation on the coil is quickly driven off. This allows the pressure buildup of refrigerant in the evaporator coil and at the suction side of the compressor, sufficient eventually to cause the bellows to close switch 78, thereby recycling the compressor.

It is possible also, particularly when the unit is used only as a refrigerator, to control the duration of the cool down cycle according specifically to the temperature of the food being cooled, and this can be done by means of temperature probes. Shown in FIG. 4 are schematic examples of four probes 80 which are independently connected through selector switch 82 to a probe indicator 84. The indicator is in a 110V power circuit with the timer contact 70 to be active whenever the cool down cycle is instigated. The probes are physically inserted into the food at different locations in the enclosure and thus sense representative interior food temperatures. The selector 82 can span the probes being manually shifted or shifted automatically by available equipment, and eventually the determination is made that the desired food temperature has been reached which activates the probe indicator. This in turn sends out a hot power signal that energizes the coil 87 and thus opens the switch contact 86. The open contact 86 terminates the operation of the outboard fans 34 and also shifts the relay 66 back to contact 65 to bring the temperature control 60 into play once again. This automatic control can be selectively deactivated by opening switch contact 90; but the probe signal can be utilized to energize a signal device 91, which could be audible and/or visual, and which also could be located at some distance from the cabinet unit. A switch 92 can likewise be used to disconnect this device if such were not desired.

A preferred manner of use of the refrigeration cabinet would include the mass cooking of food stuff, where pans of the cooked food might then be loaded onto a wheeled cart and rolled at the cooked temperature into the cabinet to begin the fast cool down cycle. The normal cooling capacity of the refrigeration system far exceeds that needed merely to maintain the same mass of food stuff at the desired storage temperature, which with the continuous operation during the cool down cycle of the inboard fans 30 and the outboard fans 34 quickly cools the product to below the 45° F safe temperature. The operator would set the timer for some estimated required time to complete the cool down, from maybe only 20 minutes or so to possibly 2 – 3 hours for use as a refrigerator to possibly up to 6 – 8 hours for use as a freezer, afterwhich the timer would automatically shift operation to the conventional food storage cycle. The disclosed probe sensing controls could be used also to terminate the cool down cycle should the set food temperature be reached before the timer set duration lapsed. After the cool down cycle, the product can be stored in the same cabinet operating on the conventional storage cycle, or it can be moved to a conventional refrigeration unit for sustained storage.

Because of the extreme air turbulance in the enclosure during the cool down cycle, the food should be covered or wrapped to minimize moisture evaporation from the food which would adversely affect the texture and taste of the food.

What is claimed is:

1. A refrigeration cabinet having an optional fast cool down cycle, the combination comprising partition structure in the cabinet separating a food storage enclosure from a plenum, refrigeration means including an evaporator coil located in the plenum, said partition structure having inlet and outlet opening means for ducting enclosure air to and over the evaporator coil and back to the enclosure, first fan means located between the inlet opening means and the evaporator coil and second fan means located between the evaporator coil and the outlet opening means, a control for operating the cabinet either on a conventional food storage cycle or on a fast cool down cycle, whereby the first fan means operates continuously on both cycles effective to move enclosure air through the inlet opening means and over the evaporator coil and from the outlet opening means back to the enclosure and the second fan means operates only on the cool down cycle effective to force the chilled air in the plenum downstream of the evaporator coil directly from the outlet opening means for greatly increased air turbulence within the enclosure, the control also including first means adapted with the cabinet operating on the storage cycle to cycle the refrigeration means on and off effective to maintain the enclosure air generally below a set temperature and second means adapted with the cabinet operating on the cool down cycle to bypass the first control means effective generally to operate the refrigeration means continuously, and the control also including third means to stop the fast cool down cycle and to shift back to the storage cycle.

2. A refrigeration cabinet according to claim 1, wherein the outlet opening means includes a pair of openings in the partition structure at locations outboardly spaced from the inlet opening means.

3. A refrigeration cabinet according to claim 2, further including outlet slots formed in the partition structure adjacent respective top and bottom cabinet walls and spaced outboardly of the outlet openings.

4. A refrigeration cabinet according to claim 1, wherein the refrigeration means has cooling capacity at least twice and preferably three times that normally required merely to maintain the enclosure at and below a set temperature of 45° F.

5. A refrigeration cabinet according to claim 4, wherein the outlet opening means includes a pair of openings in the partition structure at locations outboardly spaced from the inlet opening means, and slots located adjacent the respective top and bottom cabinet walls and spaced outboardly of the outlet openings.

* * * * *